US007429908B2

(12) United States Patent
Pilniak

(10) Patent No.: US 7,429,908 B2
(45) Date of Patent: Sep. 30, 2008

(54) COIL FORM

(75) Inventor: Jurgen Pilniak, Warstein/Allagen (DE)

(73) Assignee: DET International Holding Limited, George Town, Grand Cayman (KY)

( * ) Notice: Subject to any disclaimer, the term of this patent is extended or adjusted under 35 U.S.C. 154(b) by 0 days.

(21) Appl. No.: 10/529,938

(22) PCT Filed: Oct. 1, 2002

(86) PCT No.: PCT/CH02/00545

§ 371 (c)(1),
(2), (4) Date: Oct. 18, 2005

(87) PCT Pub. No.: WO2004/032159

PCT Pub. Date: Apr. 15, 2004

(65) Prior Publication Data

US 2006/0125590 A1 Jun. 15, 2006

(51) Int. Cl.
*H01F 27/24* (2006.01)
*H01F 27/30* (2006.01)

(52) U.S. Cl. ..... 336/208; 336/212; 336/198

(58) Field of Classification Search ..... 336/198, 336/212, 208, 192
See application file for complete search history.

(56) References Cited

U.S. PATENT DOCUMENTS

| | | | | |
|---|---|---|---|---|
| 3,851,287 | A | 11/1974 | Miller et al. | |
| 4,449,111 | A | 5/1984 | Nakajima | |
| 4,639,706 | A * | 1/1987 | Shimizu | 336/170 |
| 4,652,846 | A | 3/1987 | Sobottka | |
| 4,857,876 | A * | 8/1989 | Costa | 336/165 |
| 4,904,975 | A | 2/1990 | Medenbach | |
| 6,344,786 | B1 * | 2/2002 | Chin | 336/198 |
| 6,661,326 | B2 * | 12/2003 | Yeh et al. | 336/208 |

FOREIGN PATENT DOCUMENTS

| | | |
|---|---|---|
| DE | 195 05 463 | 8/1995 |
| EP | 0 133 661 | 3/1986 |
| EP | 0 293 617 | 12/1988 |
| FR | 2 233 694 | 6/1973 |
| FR | 2 476 898 | 2/1980 |
| GB | 2 257 307 | 1/1993 |
| JP | 06 181 132 | 6/1994 |
| WO | WO 01/78090 | 10/2001 |

* cited by examiner

*Primary Examiner*—Anh T Mai
(74) *Attorney, Agent, or Firm*—Gallagher & Kennedy, P.A.; Thomas D. MacBlain

(57) ABSTRACT

A coil form for forming an inductive element (10) includes a coil body (2) and at least one, for example three separating plates (3). The coil body (2) has an opening (4.1) and includes two portions, a coil portion (6) and a flange portion (7). To put the inductive element (10) together, the separating plates (3) are pushed over the coil portion (6) of the coil body (2). For positioning of the separating plates (3), recesses (8) are provided on the surface of the coil portion (6). The separating plates (3) divide the surface of the coil portion (2) into a plurality of coil areas where the coil or the coils of the inductive component (10) can be provided, for example by winding an isolated wire around the coil portion (6) in a coil area. Afterwards, the core of the inductive component is installed by fitting the two E-shaped core parts (11.1, 11.2) together such that the middle leg (13) of each core part (11.1, 11.2) is inserted into the opening (4.1) of the core body (2).

12 Claims, 3 Drawing Sheets

COIL FORM

CROSS REFERENCE TO RELATED APPLICATIONS

This application is a National Stage application of international application No. PCT/CH02/000545 filed on Oct. 1, 2002, priority from which is here claimed.

TECHNICAL FIELD

The invention relates to a coil form for forming an inductive element with a core and at least one coil, the coil form including a hollow coil body for insertion of the core, the coil body having an outer surface for holding the at least one coil and the coil form further including at least one separating plate which surrounds the outer surface of the coil body thereby dividing the surface into a least one coil area. The invention further relates to an inductive element with such a coil form and a coil form having a hollow coil body for insertion of a core of an inductive element and having an outer surface for holding a coil of the inductive element.

BACKGROUND

In the manufacturing of electric and/or electronic components exists an ongoing demand for smaller components while their power density should be increased at the same time. This is particularly true in the manufacturing of inductive elements such as transformers, inductors or chokes. One of the major problems when reducing the size of inductive elements is to dissipate the heat, which is generated within the magnetic circuit, efficiently.

Document EP 0 133 661 shows a transformer type, which is widely known in the art, either in the formation shown or in different variations. Each winding of the transformer is wound on a separate coil body which comprises a flange on each end to hold the windings in the correct position. When the transformer is fitted together, a thin metal foil is inserted between two adjacent coil bodies to provide for electrical isolation as well as for shielding.

Since this transformer does not include an efficient cooling of the circuit, it is not suited for high power applications and its leakage inductance is quite bad.

Another transformer is described in the publication FR 2 476 898. The transformer comprises a magnetic core with three legs where all of the windings of the transformer are formed by a plurality of flat coils. As the coils are positioned directly one after another, they are electrically isolated all of their surface. The coils generally have a rectangular shape, include an air gap and are provided directly around the middle core leg.

This transformer too does not provide for efficient cooling. The flat coils are electrically isolated which prevents an efficient heat dissipation. Furthermore, this type of transformer can not be used in applications, where at least one of the transformer windings shall be realised with isolated copper wires.

In order to provide transformers that require only a small space, planar transformers where the windings are formed by copper traces that are etched on a printed circuit board, have been introduced. Furthermore, different cooling methods are known to enhance heat dissipation. However, while planar transformers are suited very well in certain applications, they are not useful in other applications.

SUMMARY OF THE INVENTION

It is therefore an object of the invention to provide a coil form of the kind initially mentioned, particularly to provide a coil form for forming of a small transformer with enhanced heat dissipation capabilities.

A coil form according to an object of the invention is designed to form an inductive element with a magnetic core and at least one coil. The coil form includes a hollow coil body for insertion of the core and an outer surface for holding the coils. The coil form further includes at least one separating plate which surrounds the outer surface of the coil body and thereby divides the surface into at least one coil area. While the coil body is made of plastic, the separating plate is made of metal and has an opening for pushing the separating plate over the coil body. The separating plate further has a slit which prohibits leakage currents within the separating plate.

Fabricating the separating plate from metal results in several advantages of the invention. First of all, the metallic plate helps to dissipate the heat which is generated either within the plate or within the coils which are positioned directly adjacent to the plate. Efficient cooling of the inductive element can be achieved. Another advantage is that the separating plate serves as a side support for the coils that are provided within the coil area or coil areas. Furthermore, the metallic plates have a positive effect on the leakage inductances and the overall stability of the coil form.

While many different shapes of the coil body are possible, for example a coil body that has an overall cylindrical shape, the coil body preferably includes two portions, a coil portion and a flange portion on an end region of the coil portion. The coil portion is of the kind of a hollow cylinder on the surface of which the coils of the inductive element are provided. The core of the inductive element is insertable into the coil portion. On its outer surface, the coil portion includes at least one recess for positioning and holding the separating plate in the correct position.

The coils of the inductive element, which are provided on the surface of the coil body, have to be connected to a corresponding electrical circuit. The ends of the coils could be connected directly to another component of the electrical circuit or to a corresponding contact bank where the electrical circuit is connected to as well.

In an advantageous embodiment of the invention, the flange portion includes a plurality of terminals where at least an end of the at least one coil is electrically conductively connectable to one on the terminals. The size, shape and arrangement of the terminals can be such that they can be connected directly to corresponding taps or connectors of a printed circuit board or the like.

The separating plate, either its outline or the outline of its opening, can be of any shape. However, it is advantageous to choose the shape of the opening of the separating plate such that it substantially corresponds to the shape of the outer surface of the coil portion of the coil body. The shape of the separating plate is chosen such that an internal diameter of the separating plate (the diameter of the opening) is smaller than a corresponding outer diameter of the coil body. This means that the opening of the separating plate is smaller than the coil body.

Therefore, either the coil body or the separating plate have to be deformed to push the separating plate in its correct position. In order to deform the separating plate, which is made of metal, it would have to be made very thin, which would cause unwanted instabilities of the coil form. It is more useful to build the coil body such that it is deformable. This can be either achieved by using a flexible plastic or it can be achieved by a divided coil body which comprises at least two elements. The elements are formed such that they include means to fit them together to form the coil body. Hence, the coil body can be pressed together in order to push the separating plate in its correct position on the outside of the coil body.

While the divided coil body can comprise three or more elements, it is sufficient that it comprises only two elements. While any kind of positive or non-positive locking is suited to connect the elements, it is preferred that the means to fit the two elements together include a recess on the first element and a corresponding projection on the second element.

There are many ways to divide the coil body into two elements. One can for example think of almost any plane which intersects the coil body to divide it into two elements. However, as the coil portion of the coil body according to the invention is preferably built of the kind of a right cylinder where the base planes are perpendicular to the outer surface of the coil portion, the coil body is preferably divided into two elements by a plane which is perpendicular to a base plane of the right cylindrical coil portion. As used herein, the expression "a kind of a right cylinder" shall mean a hollow right cylinder-like body, but not necessarily circular in cross-section. For example, in the exemplary preferred embodiments of the invention described below, the coil body is more rectangular in cross-section than circular.

As mentioned above, the inductive element which can be formed with the coil form according to the invention, includes at least one coil. The coil or the coils can for example be realised by an insulated wire which is wound around the surface of the coil body in one of the coil areas provided on the surface of the coil portion by the separating plate. Such wire winding coils typically form a primary winding of the inductive element.

In another preferred embodiment of the invention, the at least one coil is formed by the separating plate. That is the separating plate forms a winding of the at least one coil. By providing a plurality of separating plates and connecting them in a suitable way, it is possible to provide a coil with a plurality of windings. As the number of windings of such a coil typically is smaller than the number of windings of a wired coil, the plate winding coil typically is a secondary winding of the inductive element, leading a higher current than the primary wire winding.

If a separating plate is used as a winding, the separating plate has two terminal projections, that are positioned preferably in near the slit. These terminal projections are for example built such that the separating plate or the separating plates can be easily connected to a printed circuit board. The circuit board includes corresponding holes or slits where the terminal projections can be inserted and for example bonded to by solder.

An inductive element according to the invention is manufactured by utilising a coil form according to the invention as described above. A magnetic core is inserted into the hollow coil body of the coil form and the separating plate is pushed over the coil body. At least one coil is provided on the outer surface of the coil body.

Although one metal separating plate would be sufficient to provide an inductive element according to the invention, in some applications, the inductive element advantageously includes a plurality of metal separating plates. This can be done for example to increase the number of coil areas or, where the separating plates form a winding of a coil, to increase the number of windings of such a coil.

In order to increase the number of windings of a plate winding coil, two or more separating plates can be provided directly one after the other without forming any coil areas between two adjacent plates. To prevent short circuits between two adjacent separating plates, an isolation plate (electrical isolation) is provided between two adjacent separating plates. The shape of such an isolation plate corresponds to the shape of the separating plates. As an isolation plate does not conduct electrical current, there is no slit necessary in an isolation plate.

As already mentioned before, in some applications it is useful to realise some or all of the necessary coil windings by one or more separating plates instead of realising some or all of the necessary coils by wire windings.

The coil form according to the invention is suited to implement many different types of inductive elements like for example different types of transformers, inductors or chokes for usage in many different applications. It is also possible to utilise magnetic cores with different shapes such as for example E, U or I-shaped cores.

A widely used core type has a double rectangular shape, that is a core with two rectangular portions that have a common edge. To manufacture an inductive element according to the invention, the utilisation of such double rectangular core is preferred and where the common edge of the core is inserted into the hollow coil body.

To build such a double rectangular core, an E-shaped and an I-shaped part could be used and the middle leg of the E-shaped part is inserted into the coil body. Advantageously it can also be built from two E-shaped core halves where the middle leg of each core half is inserted into the coil body from one side of the coil body respectively.

Coil bodies which comprise two or more elements that can be fitted together by corresponding fitting means, can also be used without metal separating plates. That is they can be used in coil forms, where the separating plates are not made of metal but made of plastic.

In such coil forms, the coil body and the separating plate can build up one single piece or the separating plates can, according to another embodiment, form an additional part of the coil form. They can form for example a hollow outer coil body which can be fitted over the (inner) coil body. The separating plate can be fitted over the outer coil body to provide the coil areas. The advantage of such a configuration is, that different kinds of outer coil bodies can be pre-manufactured and fitted over the (inner) coil body to realise different kinds of coil forms with a single (inner) coil body.

From the following detailed description and from the entirety of the claims it will be clear to a person skilled in the art, that there are more advantageous embodiments and feature combinations of the invention.

DESCRIPTION OF THE DRAWINGS

The drawings used for illustration of the examples show.

In general, the same objects in different drawings are given the same reference numerals.

DETAILED DESCRIPTION OF PREFERRED EMBODIMENTS

Figure 1:
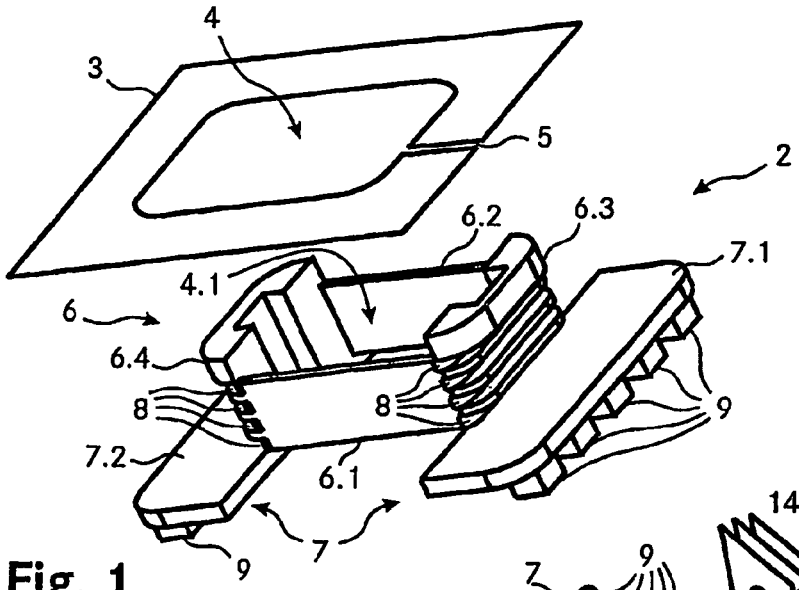
FIG. 1 A coil form according to the invention in a perspective view.

FIG. 1 shows a perspective view of the coil form 1 according to an embodiment of the invention. The coil form 1 includes a coil body 2 and a separating plate 3. The separating plate 3 is for example made of copper or aluminium or any other metal with high heat conducting capabilities and has a thickness of about 0.3 mm to 0.5 mm. The separating plate 3 has a rectangular shape, comprises an opening 4 with rectangular shape as well and includes a slit 5 which is directed from the outer boarder to the opening 4, thereby interrupting any conductive path around the opening 4 of the separating plate 3.

The coil body 2 comprises a coil portion 6 and a flange portion 7. The coil portion 6 has substantially the shape of a hollow right cylinder with four side walls 6.1, 6.2, 6.3, 6.4 around an opening 4.1 for insertion of a magnetic core (not shown) of a transformer. The flange portion 7 is divided into two flange parts 7.1, 7.2, where each flange part 7.1, 7.2 is connected to one of the side walls 6.3, 6.4. On the outer surface of the side walls 6.3, 6.4 recesses 8 are provided for positioning separating plates 3 after fitting them over the coil portion 6.

On the lower side of the flange portion 7, terminals 9 are located. Due to the perspective view of FIG. 1, some of the terminals 9 are not visible.

Figure 2:
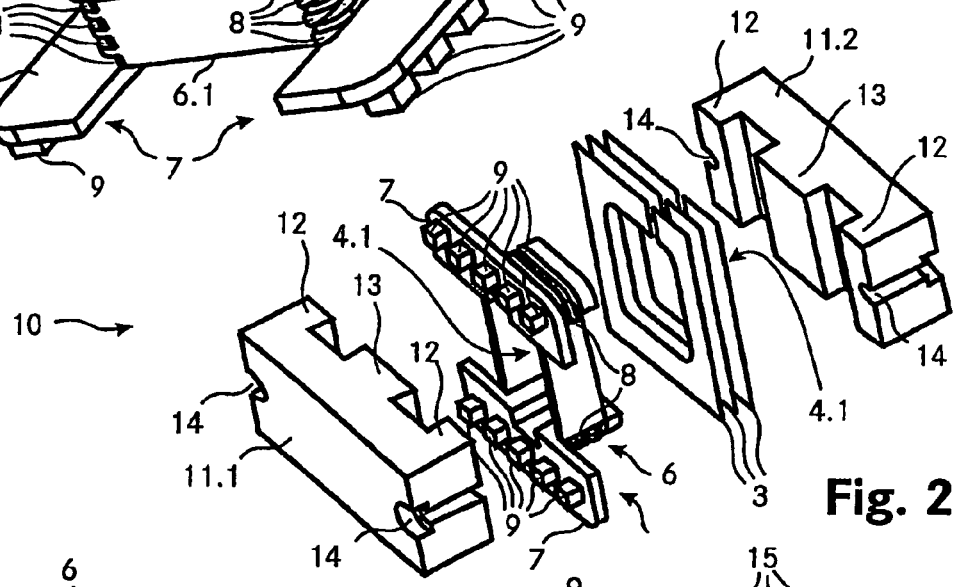
FIG. 2 a transformer body with the coil form show in FIG. 1 in a perspective, exploded view.
Figure 3:
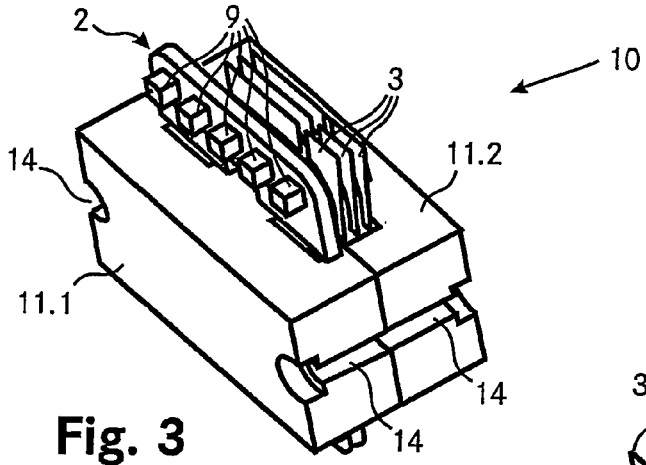
FIG. 3 the assembled transformer from FIG. 2.

In FIG. 2, an exploded perspective view of a transformer body 10 with the coil form 1 is shown. FIG. 3 shows the same transformer body 10 assembled. Unlike in FIG. 1, three separating plates 3 are provided. The transformer body 10 includes a magnetic core 11 which consists of two E-shaped core parts 11.1, 11.2 which include two outer legs 12 and a middle leg 13 respectively. The recesses 14 on the outer legs 12 are provided for mounting clamps (not shown) to hold and press the E-shaped parts 11.1, 11.2 of the core 11 together. It is to mention that the needed wire windings have to be wound around the coil body 2 before the clamps are mounted around the transformer body 10.

To assemble the transformer body 10, the separating plates 3 are pressed over the coil body 2 and then the E-shaped parts 11.1, 11.2 of the core 11 are fitted together by inserting the middle legs 13 into the opening 4.1. E-shaped part 11.1 is inserted from the front (as shown in FIG. 2) and E-shaped part 11.2 is inserted into the opening 4.1 from behind. Then the transformer body is clamped together for example by mounting clamps in the recesses 14.

In the assembled transformer body 10, both outer separting plates 3 are directly in touch with the E-shaped parts 11.1, 11.2 of the core 11. Hence, the heat generated within the windings of the transformer can be efficiently dissipated via the separating plates 3 to the core 11, which functions as a heat sink.

Figure 4:
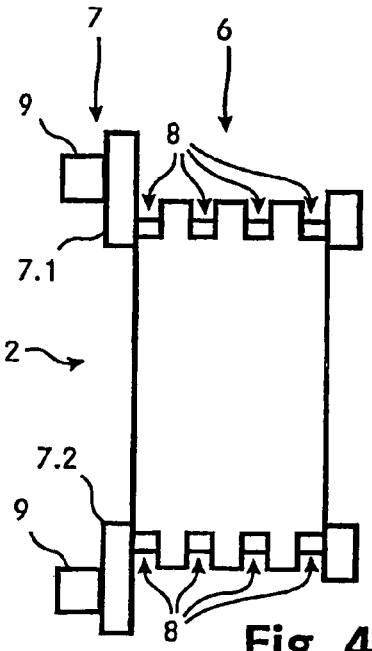
FIG. 4 the coil form as shown in FIG. 1 in a side view.

FIG. 4 shows the coil body 2 with four separating plates 3 in a side view. The separating plates 3 are not yet fitted over the coil portion 6 and no wire windings are provided on the surface of the coil portion 6. In this view, the recesses 8 for holding the separating plates 3 and the terminals 9 on the flange parts 7.1, 7.2 can be seen clearly.

Figure 5:
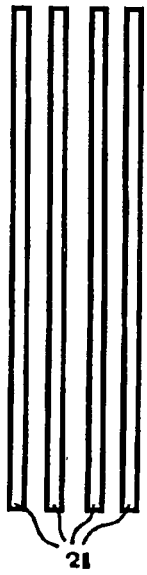
FIG. 5 the coil form as shown in FIG. 3 assembled and with wire windings.
Figure 5:
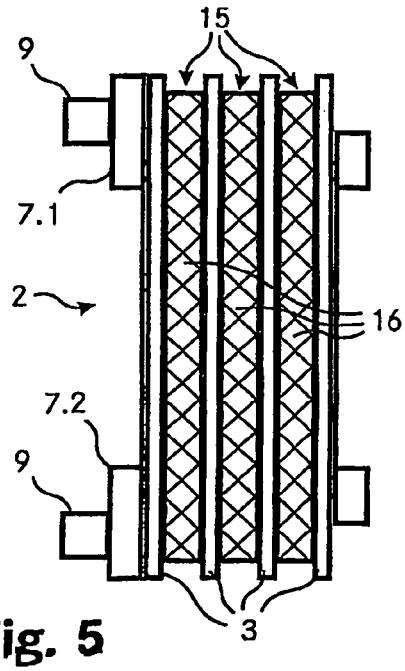

FIG. 5 shows the same coil body 2 as FIG. 4 but here, the four separating plates 3 are fitted over the coil portion 6 thereby dividing the surface of the coil portion 6 into three coil areas 15. In each of these coil areas 15, a wire winding 16 is provided on the surface of the coil portion 6.

When a transformer with a coil body 2 as shown in FIG. 5 is in operation, the wire windings 15 generate a lot of heat. This heat is generated just near the separating plates 3 which are made of a metal such as for example copper or aluminium or any other metal with high heat conducting capabilities. This means that the separating plates not only serve as a side support for the wire windings 15 but also dissipate the heat generated within the wire windings 15 efficiently. As mentioned above, the separating plates 3, or at least some of them, are in direct contact with the core 11 which helps to dissipate even more heat.

At this point, it is to mention, that FIG. 5 shows a small space between the outermost separating plates 3 and the flange portion 7 and the other side of the coil body 2. However, as the separating plates 3 are in direct contact with the flange portion 7 (and with the smaller flange portion on the other side), there are no such spaces. This is also true for other figures, such as for example FIG. 8, where there seems to be a small space between the separating plates 3.1 and the insulation plates 19.

Figure 6:
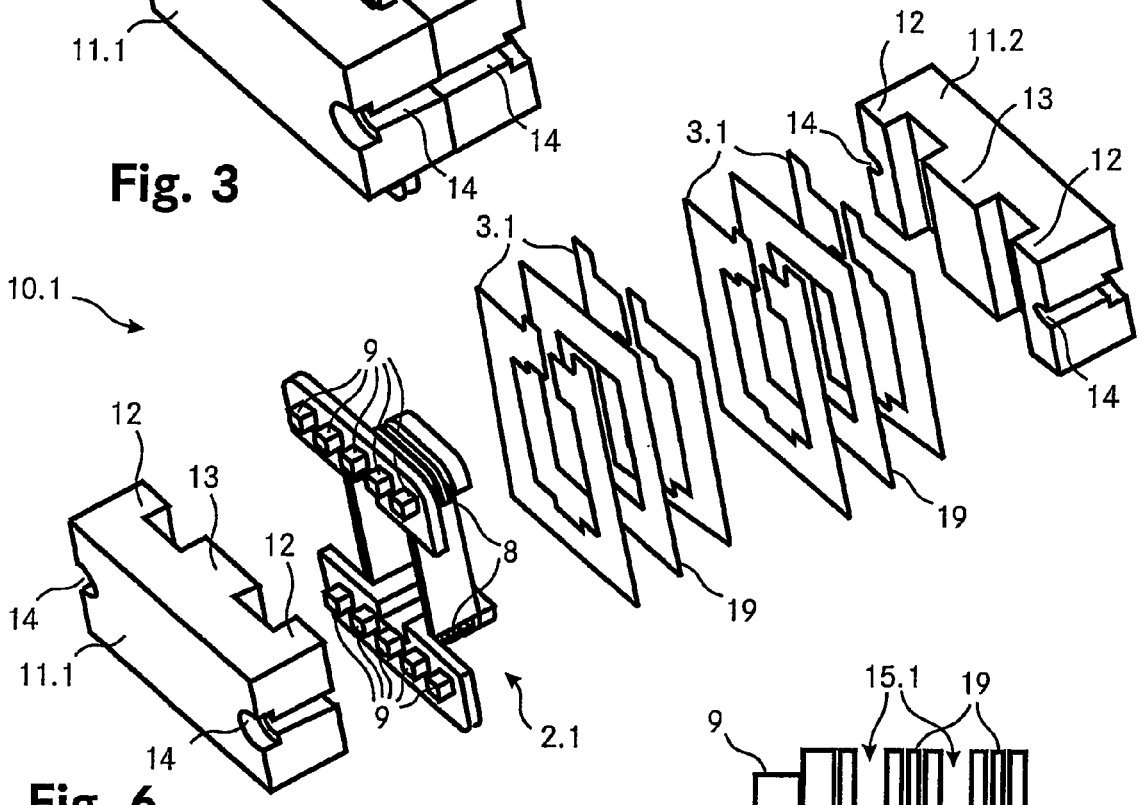
FIG. 6 a further transformer body in an exploded perspective view.

FIG. 6 shows an exploded perspective view of another transformer body 10.1 with a further embodiment of a coil form 1.1 according to the invention. The coil body 2.1 is almost the same as the coil body 2 in the transformer body 10 of FIG. 2. The only difference is, that it comprises just two recesses 8 on the surface of the coil portion 6.1.

Figure 7:
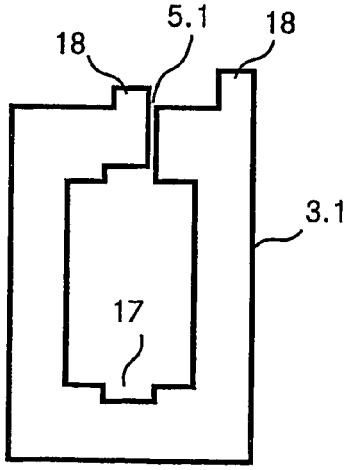
FIG. 7 a separation plate of the transformer of FIG. 6.

There are four separating plates 3.1 which are arranged in two groups and which have slightly a different shape than the separating plates 3 of FIGS. 1 and 2. The shape of the separating plates 3.1 is shown in more detail in FIG. 7. The separating plates 3.1 have a recess 17 on the lower edge of the opening 4 and on both sides of the slit 5.1 they have a terminal projection 18. At this point it is to say that, although all of the four separating plates 3.1 have the same shape, two of them (that is one in each group as shown in FIG. 6) are laterally reversed.

As already mentioned, the separating plates 3.1 are arranged in two groups, where each group includes two separating plates 3.1, one of them being laterally reversed. To prevent current flow from one separating plate to another within a group, an insulation plate 19 is provided between the two separating plates 3.1 of one group.

The terminal projections 18 can be used to connect the separting plates 3.1 to a printed circuit board (not shown) with corresponding holes or slits where the terminal projections 18 can be inserted and for example bonded to by solder. Then, the separating plates 3.1 can be interconnected in the desired manner by traces on the printed circuit board to form the necessary windings.

Figure 8:
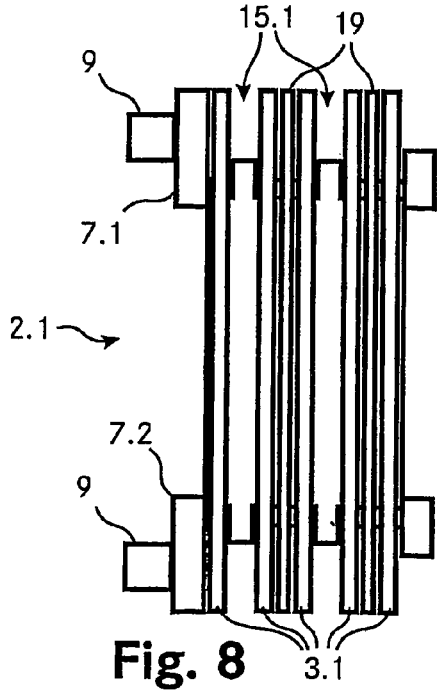
FIG. 8 the coil form of FIG. 6 with assembled separating plates.

FIG. 8 shows the coil body 2.1 of FIG. 6 in a side view. On the outer surface of the coil portion 6.1 two recesses 8 are provided where the two plate groups, each group including two separating plates 3.1 and an insulation plate 19 between them, are positioned. The plate groups divide the outer surface of the coil body 2.1 into two coil areas 15.1.

Within the coil areas 15.1 two wire windings (not shown) can be provided in a similar way as shown in FIG. 5. These wire windings could for example form one (or more) primary windings of a transformer, while the separating plates 3.1 form one (or more) secondary windings of the transformer. For this purpose, the terminal projections 18 of the separating plates 3.1 are electrically conductively connected such that the needed number of coils with the necessary number of turns in the correct direction results. In this case, where the separating plates 3.1 are utilised as a coil of the inductive element, they have not only to be made of a good heat conducting material, but the material has also to be a good electrical conductor. Hence, it is preferred to make the separating plates of copper or aluminium or any other metal with high heat and electrical current conducting capabilities.

Figure 9:
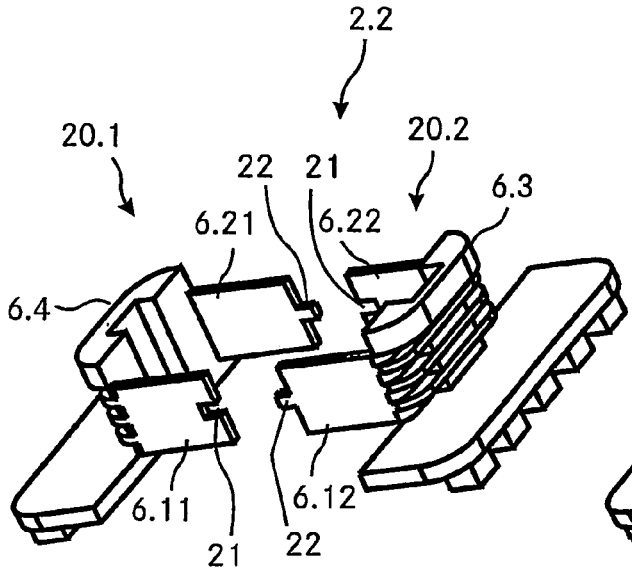
FIG. 9 a divided coil body according to the invention in an exploded view.
Figure 10:
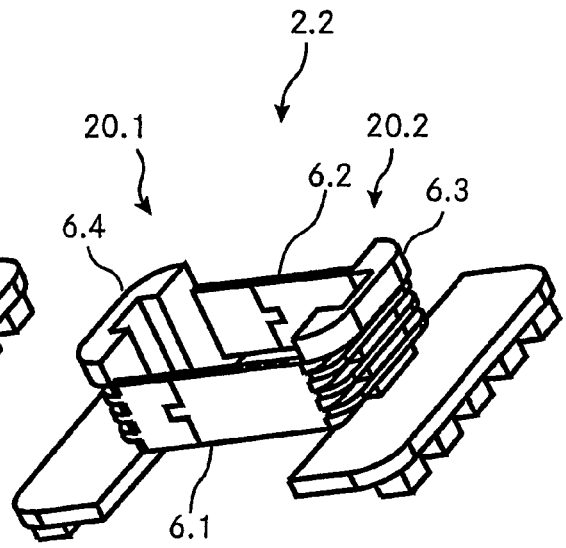
FIG. 10 the assembled divided coil body from FIG. 8.

FIGS. 9 and 10 show a coil body 2.2 which is very similar to the coil body 2 of FIG. 1. The difference is, that the coil body 2.2 is divided into two elements 20.1, 20.2. FIG. 9 shows the assembled coil body 2.2 where the two elements 20.1, 20.2 are fitted together and FIG. 10 shows the coil body 2.2 in an exploded view.

The coil body 2.2 is divided along a plane which is parallel to the planes of the side walls 6.3 and 6.4 and divides each of the side walls 6.1, 6.2 in two side wall sections 6.11, 6.12 and 6.21, 6.22 respectively.

To fit the elements 20.1, 20.2 together, there is a recess 21 provided on the front edge of side wall sections 6.12 and 6.21 and a corresponding projection 22 is provided on the front edge of side wall sections 6.11 and 6.22.

To summarise it can be stated that the preferred embodiment teaches a coil form which enables the forming of inductive elements which can for example be manufactured very low and flat. Furthermore, an efficient heat dissipation can be achieved thanks to the metallic separating plates which are positioned directly adjacent the heat source.

The invention claimed is:

1. A coil form for forming an inductive element with a core and at least two coils, including a) a hollow coil body for insertion of the core, the coil body having an outer surface b) and at least one separating plate which surrounds the outer surface of the coil body thereby providing at least one coil area on the surface of the coil body, wherein c) the coil body is made of plastic and includes at least one recess on its outer surface for positioning and holding the at least one separating plate, d) the separating plate is made of metal, having an opening for pushing the separating plate over the coil body and having a slit for prohibiting leakage currents within the separating plate, e) the separating plate forms a winding of one of the at least two coils f) and in that another coil of said at least two coils includes an insulated wire wound around the coil body in said at least one coil area, the separating plate being a side support for said wire and dissipating heat generated within the wire.

2. A coil form according to claim 1, wherein the coil body includes a coil portion of a kind of a hollow cylinder for slipping over the separating plate and a flange portion on an end region of the coil portion.

3. A coil form according to claim 2, wherein the flange portion includes a plurality of terminals where at least one terminal is electrically conductively connectable to an end of one of the at least two coils.

4. A coil form according to claim 1, wherein a shape of the opening of the separating plate substantially corresponds to a shape of the outer surface of the coil body and in that an internal diameter of the separating plate is smaller than an outer diameter of the coil body.

5. A coil form according to claim 1, wherein the coil body comprises at least two elements with means to fit the elements together to form the coil body.

6. A coil form according to claim 5, wherein the coil body comprises a first and a second element and in that the means to fit the elements together include a recess on the first element and a corresponding projection on the second element.

7. A coil form according to claim 5, wherein the coil portion is of a kind of a right cylinder, where the coil body is separated into two elements by a plane being perpendicular to a base plane of the right cylindrical coil portion.

8. An inductive element with a coil form according to any of claims 1 to 7, a core inserted into the hollow coil body and at least one coil, provided on the outer surface of the coil body.

9. An inductive element according to claim 8, further comprising a plurality of separating plates, where an isolation plate is provided between two adjacent separating plates.

10. An inductive element according to claim 8, wherein at least one winding of the at least one coil is formed by the separating plate.

11. An inductive element according to claim 8, wherein the core of the inductive element has a shape of two rectangular portions with a common edge, where the common edge is inserted into the hollow coil body and whereby the core includes two B-shaped parts.

12. A coil form having a hollow coil body for insertion of a core of an inductive element and having an outer surface for holding each coil of the inductive element, wherein the entire coil body is split into at least two elements with means to fit the elements together to form the coil body, and wherein the coil body includes a flange portion and a coil portion which is of a kind of right cylinder, where the coil body is separated into two elements by a plane being perpendicular to a base plane of the right cylindrical coil portion, and further comprising a separating plate for separating coils on the coil body, and an additional hollow outer coil body for insertion of the coil body and for pushing over the separating plate.

* * * * *